US007104290B2

(12) United States Patent
Tseng

(10) Patent No.: US 7,104,290 B2
(45) Date of Patent: Sep. 12, 2006

(54) JOINT FOR A FLUID PUMPING APPARATUS

(76) Inventor: Tien Tsai Tseng, No. 27, Lane 57, Fengzheng Rd., Wufeng Shiang, Taichung County (TW)

( * ) Notice: Subject to any disclaimer, the term of this patent is extended or adjusted under 35 U.S.C. 154(b) by 211 days.

(21) Appl. No.: 10/800,745

(22) Filed: Mar. 16, 2004

(65) Prior Publication Data

US 2004/0261901 A1 Dec. 30, 2004

(30) Foreign Application Priority Data

Jun. 6, 2003 (TW) ..... 92210437 U

(51) Int. Cl.
*B65B 31/04* (2006.01)

(52) U.S. Cl. ..... 141/65; 141/59; 141/323; 137/205

(58) Field of Classification Search ..... 141/65, 141/59, 60, 61, 42, 323; 137/205
See application file for complete search history.

(56) References Cited

U.S. PATENT DOCUMENTS 1,443,977 A * 2/1923 Carr ..... 141/42
1,913,078 A * 6/1933 Hays ..... 141/42
1,986,476 A * 1/1935 Ironside ..... 141/28
2,130,059 A * 9/1938 Bosh et al. ..... 141/43
2,141,427 A * 12/1938 Bryant ..... 417/120
2,317,589 A * 4/1943 Collinson ..... 141/42
3,051,195 A * 8/1962 Stenberg ..... 137/501
3,455,346 A * 7/1969 Stork ..... 141/42
4,782,689 A * 11/1988 DeRome ..... 73/49.2
4,964,784 A * 10/1990 Vanderheyden ..... 417/86
5,265,653 A * 11/1993 Herlth ..... 141/65
5,425,333 A * 6/1995 Baylor et al. ..... 123/41.14
5,427,505 A * 6/1995 Payne ..... 137/205
6,722,855 B1 * 4/2004 Tien-Tsai ..... 137/202
6,755,207 B1 * 6/2004 Curtis et al. ..... 137/205

* cited by examiner

*Primary Examiner*—Khoa D. Huynh
(74) *Attorney, Agent, or Firm*—Rosenberg, Klein & Lee

(57) ABSTRACT

A joint for a fluid pumping apparatus includes a body having a passage defined in the body and extending through the body. A through hole is longitudinally defined in the body and extends through the body. A container is mounted to a lower end of the body, and the passage and the through hole communicate with the interior of the container. A connecting seat in mounted to an upper end of the body and has hollow connector communicating with the through hole in the body. A hose has a first end connected to the hollow connector and a second extending into a pail containing fluid. Consequently, the fluid in the pail can be sucked into the container when a compressed air flows through the passage in the body.

7 Claims, 5 Drawing Sheets

JOINT FOR A FLUID PUMPING APPARATUS

BACKGROUND OF THE INVENTION

1. Field of the Invention

The present invention relates to a joint, and more particularly to a joint for a fluid pumping apparatus.

2. Description of Related Art

A conventional oil-pumping device usually has a complicated structure and a great volume. It is an inconvenient design. Further, the container of the conventional oil-pumping device for receiving the pumped oil uniquely corresponds to the oil-pumping device. Consequently, the user often needs to clean the container after the being used for next use when sucking the fluid that is different from the previous operation.

The present invention has arisen to mitigate and/or obviate the disadvantages of the conventional oil-pumping device.

SUMMARY OF THE INVENTION

The main objective of the present invention is to provide an improved joint for a fluid pumping apparatus.

To achieve the objective, the joint in accordance with the present invention comprises a body including a trough defined in an upper portion of the body, an insertion longitudinally extending from a lower portion of the body and adapted to be inserted into an opening of a container. A passage is defined in and extending through the body to communicate with an interior of the container. A through hole is longitudinally defined in the body and communicates with the interior of the container, wherein the passage is adapted to be connected to a compressed air source and a minus is caused in the container when the compressed air passes through the passage in the body. A connecting seat includes an insertion inserted into the trough in the body and a hollow connector extending from the connecting seat. The hollow connector communicates with the through hole in the body and is connected to a hose that extends into a pail receiving the fluid for being pumped when the compressed air passage the passage in the body.

Further benefits and advantages of the present invention will become apparent after a careful reading of the detailed description with appropriate reference to the accompanying drawings.

DETAILED DESCRIPTION OF THE INVENTION

Figure 1:
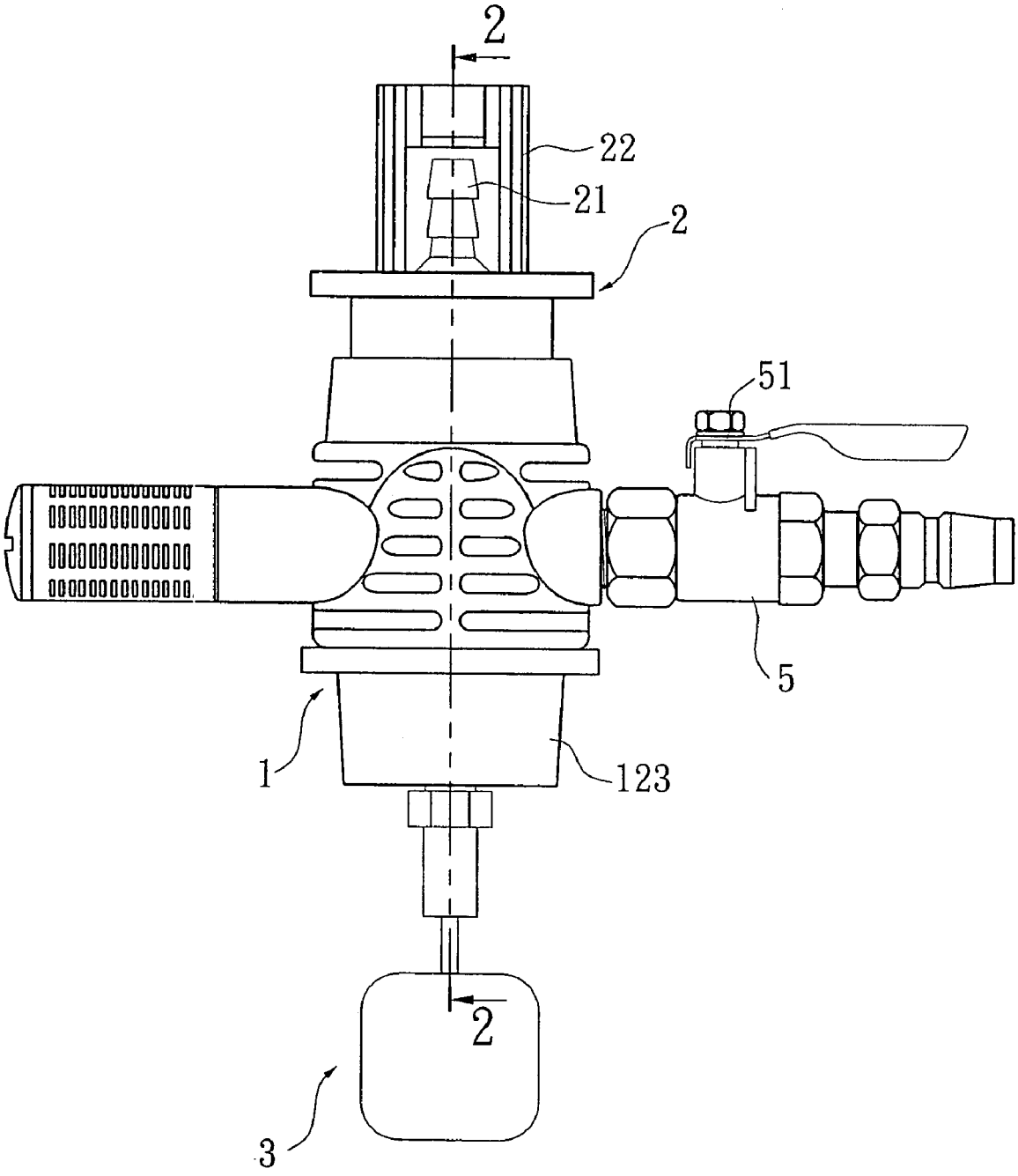
FIG. 1 is a side plan view of a joint for a fluid pumping apparatus in accordance with the present invention.
Figure 2:
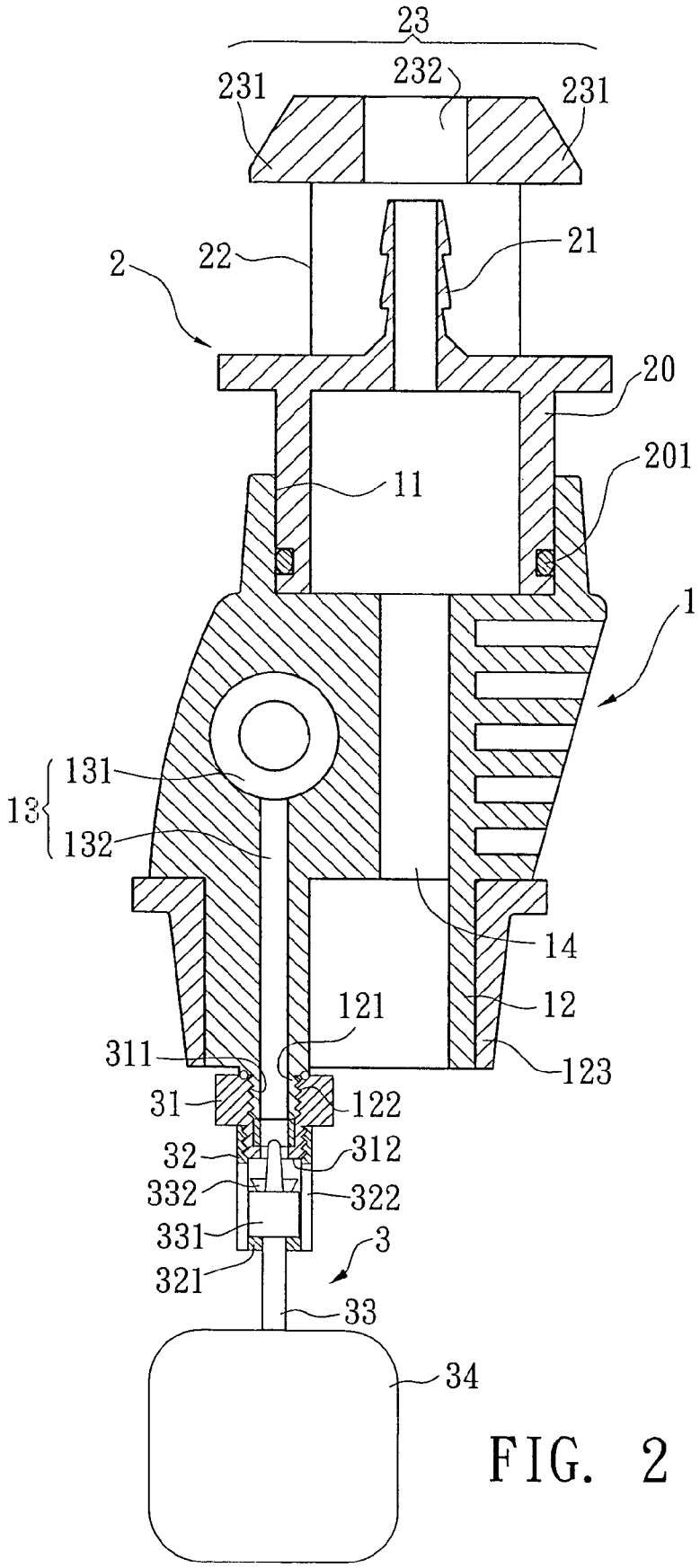
FIG. 2 is a cross-sectional view of the joint in FIG. 1 along line 2—2.

Referring to the drawings and initially to FIGS. 1 and 2, a joint for a fluid pumping apparatus in accordance with the present invention comprises a body (1), a connecting seat (2) movably mounted to an upper portion of the body (1) and an automatic stop device (3) movably mounted to a lower portion of the body (1).

Figure 3:
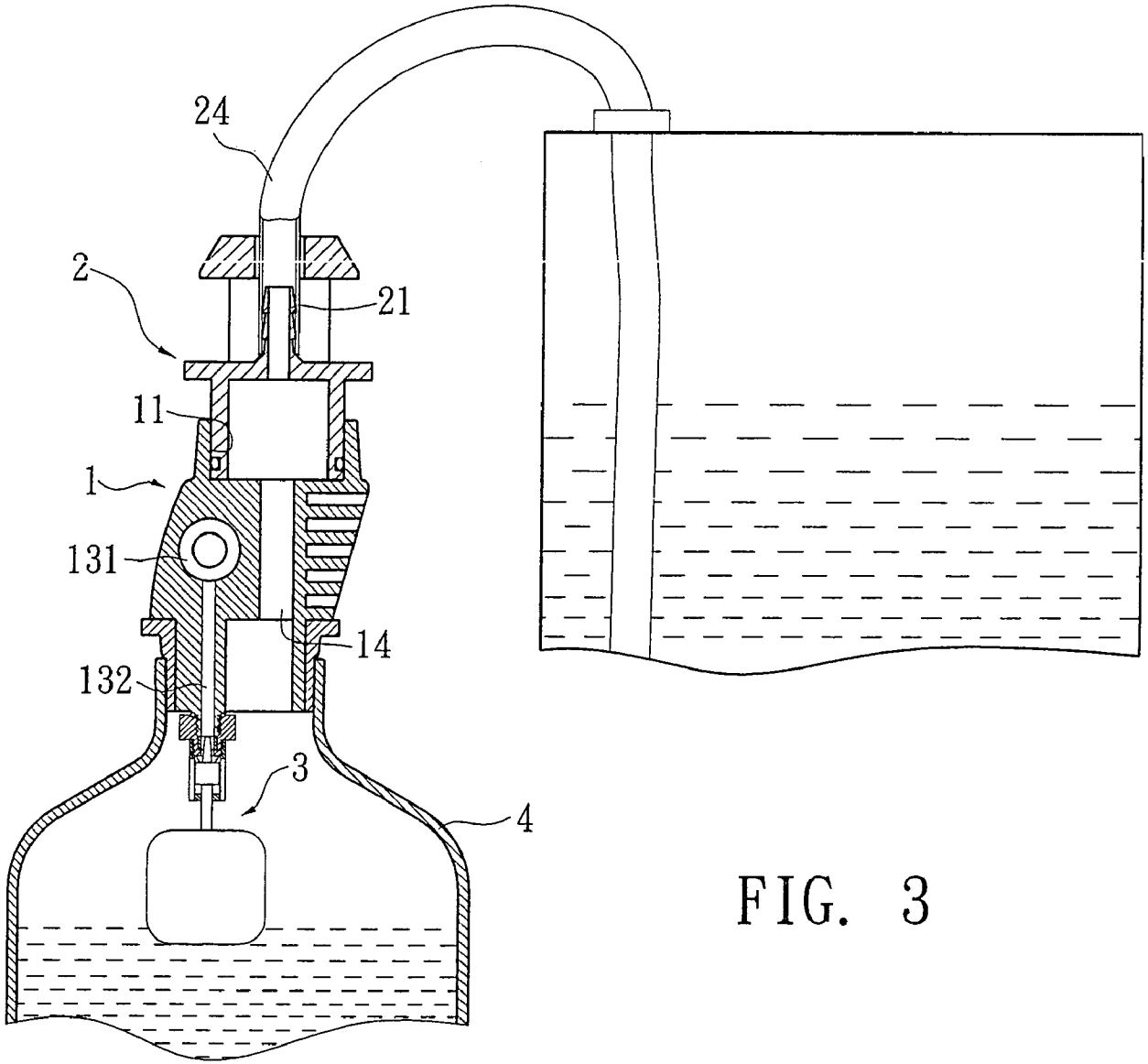
FIG. 3 is an operational view of the joint in FIG. 1.
Figure 4:
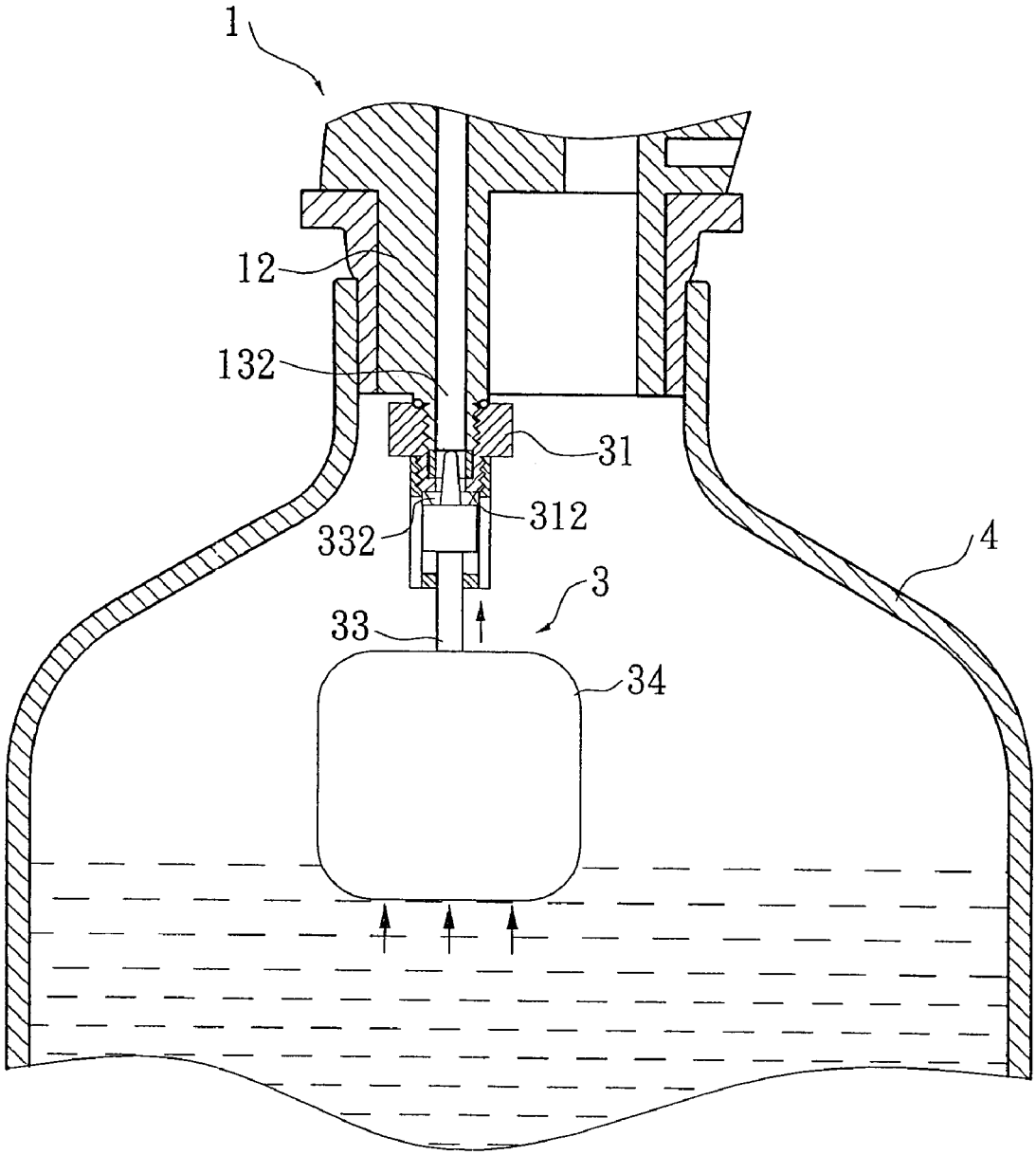
FIG. 4 is an operational view of an automatic stop device of the joint of the present invention.

The body (1) comprises a trough (11) defined in the upper portion of the body (1) for partially receiving the connecting seat (2). In the preferred embodiment of the present invention, the trough (11) is circular. An insertion (12) downward extends from the lower portion of the body (1) and a tapered sealant (123) is mounted around the insertion (12). The sealant (123) is made of rubber, silica gel and the like. The diameter of the sealant (123) is gradually reduced relative to a distal end of the insertion (12) for providing an airtight effect when the insertion (12) is inserted into an opening (not numbered) of a container (4), as shown in FIGS. 3 and 4. A T-shaped passage (13) is defined in the body (1) for communicating with a high-pressure air source and an interior of the container. The passage (13) includes a first path (131) defined in and laterally extending through the body (1), and a second path (132) longitudinally defined in the body (1). The second path (132) has two opposite ends respectively communicating with the first path (131) and the interior of the container (4) such a minus pressure is caused in the container (4) when a high-pressure air current flows through the first path (131) of the passage (13) in the body (1). A faucet (5) is mounted to one end of the first path (131) and a valve (151) is mounted in the faucet (5) for selectively opening the first path (131) of the passage (13) in the body (1). A hollow stub (121) downward extends from the lower portion of the body and centrally longitudinally corresponds to the second path (132). The hollow stub (121) has a threaded outer periphery for the automatic stop device (3) being mounted on the body (1). A through hole (14) is longitudinally defined in the body (1) behind the T-shaped passage (13).

Figure 5:
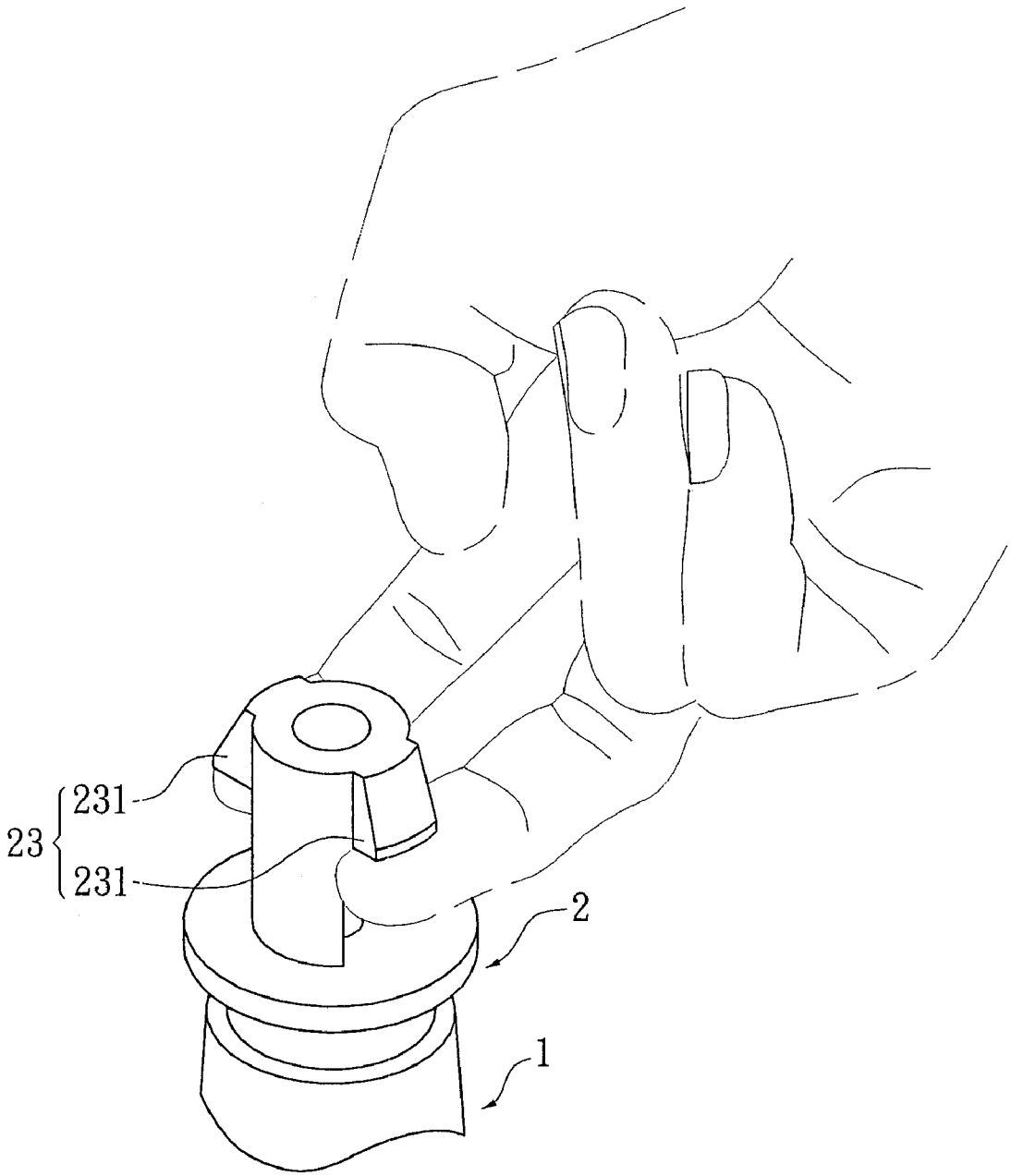
FIG. 5 is an operational view of a connecting seat of the joint of the present invention.

The connecting seat (2) includes an insertion (20) partially received in the trough (11) in the body (1). An O-ring (201) is mounted around the insertion (201) and abutting an inter periphery of the trough (11) for providing an airtight effect between the inner periphery of the trough (11) and the outer periphery of the insertion (20). A hollow connector (21) extends from the insertion (20) and communicates with the through hole (14) in the body (1). The hollow connector (21) is adapted to be connected with a hose (24) that extends into a pail (not numbered) containing fluid. Two supports (22) longitudinally extend from the insertion (20) and diametrically corresponding to each other relative to the hollow connector (21). A handle (23) is formed on a free end of each of the two supports (22) and has a flange (231) outwardly extending therefrom for user to easily detach the connecting seat (2) from the body (1), as shown in FIG. 5. A through hole (232) is defined in the handle (23) and corresponds to the hollow connector (21) to allow the hose (24) extends through the handle (23) and being connected to the hollow connector (21).

The automatic stop device (3) includes a sleeve (31) mounted to the hollow stub (121). The sleeve (31) has a threaded through hole (311) defined therein for being screwed onto the threaded outer periphery (122) of the hollow stub (121). A plane (312) is formed on a free end of the sleeve (31) opposite to the body (1). A cylinder (32) includes a first end longitudinally mounted to the sleeve (31) and a second end having an annular flange (321) inwardly extending therefrom to define a hole (not numbered). Multiple slots (322) are longitudinally defined in the cylinder (32) and laterally extend through the cylinder (32) to prevent the automatic stop device (3) from being upwardly moved due to the pressure in the container (4). A shaft (33) has a first end inserted into the cylinder (32) and a second end having a floating element (34) mounted on the shaft (33). A stopper (331) is mounted to a middle section of the shaft (33) and has a diameter greater than that of the hole defined by the annular flange (312) to prevent the shaft (33) from being detached from the cylinder (32). A valve (332) is mounted on the stopper (331) around the shaft (33) and facing the plane (312).

With reference to FIGS. 3 and 4, when operating the joint in accordance with the present invention, the hose (24) has a first end sleeved on the hollow connector (21) and a second end extending into a pail that contains the fluid. The insertion (20) of the connecting seat (2) is inserted into the trough (11) in the body (1) and the container (4) is connected to the body (1), thereby the sealant (123) is airtightly received in the opening of the container (4). The faucet (5) is turn on to make the compressed air pass through the first path (131) of the T-shaped passage (13). According to the Bernoulli Theorem, a minus pressure is caused in the container (4) because the second path (132) communicates with the interior of the container (4). Consequently, the fluid in the pail should be suck into the container (4) via the hose (24) and the through hole (14) in the body (1) due to the minus pressure in the container (4) and the atmospheric pressure. The level of the fluid in the container (4) is gradually raised to upwardly push the floating element (3). The second path (132) is closed and stops to suck the fluid from pail when the valve (332) abuts against the plane (312), and first path (131) is closed by faucet (5) due to the level of the fluid in the container (4). With reference to FIG. 5, the user can use the flange (231) to easily pull out the connecting seat (2) from the body (1) and the container (4) can be used to store the fluid therein or draw out the fluid for next use.

Although the invention has been explained in relation to its preferred embodiment, it is to be understood that many other possible modifications and variations can be made without departing from the spirit and scope of the invention as hereinafter claimed.

What is claimed is:

1. A joint for a fluid pumping apparatus comprising:

a body including a trough defined in an upper portion of the body, an insertion longitudinally extending from a lower portion of the body and adapted to be inserted into an opening of a container, a passage defined in and extending through the body to communicate with an interior of the container, and a through hole longitudinally defined in the body and communicating with the interior of the container, wherein the passage is adapted to be connected to a compressed air source and a negative pressure is caused in the container when the compressed air passes through the passage in the body, the passage being T-shaped, the T-shaped passage including a first path laterally extending through the body and a second path communicating with the first path and the interior of the container, the insertion of the body having a hollow stub extending therefrom and communicating with the second path of the passage in the body, the hollow stub having a threaded outer periphery that is provided to connected to an automatic stop device; and a connecting seat including an insertion inserted into the trough in the body and a hollow connector extending from the connecting seat, the hollow connector communicating with the through hole in the body and adapted to be connected to a hose that extends into a pail receiving the fluid for being pumped when the compressed air passing the passage in the body.

2. The joint as claimed in claim 1, wherein an O-ring is mounted around the insertion of the connecting seat to provide an airtight effect between an outer periphery of the insertion of the connecting seat and an inner periphery of the trough in the body.

3. The joint as claimed in claim 1, wherein the body comprises a tapered sealant mounted around the insertion of the body, the diameter of the sealant gradually reduced relative to a distal end of the insertion of the body for providing an airtight effect when the insertion of the body is inserted into the opening of the container.

4. The joint as claimed in claim 1, wherein the automatic stop device comprises:

a sleeve mounted to the hollow stub, the sleeve having a threaded through hole defined therein for being screwed onto the threaded outer periphery of the hollow stub;

a plane formed on a free end of the sleeve opposite to the body;

a cylinder including a first end longitudinally mounted to the sleeve and a second end having an annular flange inwardly extending therefrom to define a hole;

multiple slots longitudinally defined in the cylinder and laterally extending through the cylinder to prevent the automatic stop device from being upwardly moved due to the pressure in the container;

a shaft having a first end inserted into the cylinder and a second end having a floating element mounted to the shaft;

a stopper mounted to a middle section of the shaft and having a diameter greater than that of the hole defined by the annular flange to prevent the shaft from being detached from the cylinder; and a valve mounted on the stopper around the shaft and facing the plane for selectively closing the passage in the body.

5. The joint as claimed in claim 1, wherein the automatic stop device comprises:

a sleeve mounted to the hollow stub, the sleeve having a threaded though hole defined therein for being screwed onto the threaded outer periphery of the hollow stub;

a plane formed on a free end of the sleeve opposite to the body;

a cylinder including a first end longitudinally mounted to the sleeve and a second end having an annular flange inwardly extending therefrom to define a hole;

multiple slots longitudinally defined in the cylinder and late4rally extending through the cylinder to prevent the automatic stop device from being upwardly moved due to the pressure in the container;

a shaft having a first end inserted into the cylinder and a second end having a floating element mounted to the shaft;

a stopper mounted to a middle section of the shaft and having a diameter greater than that of the hole defined by the annular flange to prevent the shaft from being detached from the cylinder; and a valve mounted on the stopper around the shaft and facing the plane for selectively closing the second path of the passage in the body.

6. A joint for a fluid pumping apparatus comprising:

a body including a trough defined in an upper portion of the body, an insertion longitudinally extending from a lower portion of the body and adapted to be inserted into an opening of a container, a passage defined in and extending through the body to communicate with an interior of the container, and a through hole longitudinally defined in the body and communicating with the interior of the container, wherein the passage is adapted to be connected to a compressed air source and a negative pressure is caused in the container when the compressed air passes through the passage in the body; and a connecting seat including an insertion inserted into the trough in the body and a hollow connector extending from the connecting seat, the hollow connector communicating with the through hole in the body and adapted to be connected to a hose that extends into a pail receiving the fluid for being pumped when the compressed air passing the passage in the body, the connecting seat including two supports longitudinally extending from the insertion and a handle formed on a free end of each of the two supports, the handle having a flange outwardly extending therefrom for user to easily detach the connecting seat from the body.

7. The joint as claimed in claim 3, wherein the insertion of the body has a hollow stub extending therefrom and communicating with the passage in the body, the two supports of the connecting seat diametrically correspond to each other relative to the hollow stub.

* * * * *